US009083127B2

(12) United States Patent
Maloney et al.

(10) Patent No.: US 9,083,127 B2
(45) Date of Patent: Jul. 14, 2015

(54) CONNECTION APPARATUS CONNECTABLE WITH NEUTRAL BUS

(71) Applicant: EATON CORPORATION, Cleveland, OH (US)

(72) Inventors: James Gerard Maloney, Industry, PA (US); Edward Ethber Lias, Aliquippa, PA (US)

(73) Assignee: EATON CORPORATION, Cleveland, OH (US)

( * ) Notice: Subject to any disclaimer, the term of this patent is extended or adjusted under 35 U.S.C. 154(b) by 214 days.

(21) Appl. No.: 13/888,463

(22) Filed: May 7, 2013

(65) Prior Publication Data

US 2014/0335708 A1 Nov. 13, 2014

(51) Int. Cl.

| | |
|---|---|
| ***H01R 25/00*** | (2006.01) |
| ***H01R 25/14*** | (2006.01) |
| *H01R 4/36* | (2006.01) |

(52) U.S. Cl.

CPC ..... *H01R 25/14* (2013.01); *H01R 25/142* (2013.01); *H01R 4/36* (2013.01)

(58) Field of Classification Search

USPC ..... 439/92, 94, 110, 810, 212
IPC ..... H01R 4/64,4/66, 4/34, 4/36, 13/65802, H01R 23/6873, 25/14, 25/142, 25/145
See application file for complete search history.

(56) References Cited

U.S. PATENT DOCUMENTS

| | | | | |
|---|---|---|---|---|
| 3,727,171 | A * | 4/1973 | Coles et al. | 439/110 |
| 4,700,271 | A * | 10/1987 | Iio et al. | 361/638 |
| 5,533,913 | A * | 7/1996 | Boehm et al. | 439/810 |
| 5,816,852 | A * | 10/1998 | Conrad | 439/512 |
| 6,040,525 | A * | 3/2000 | Chauquet et al. | 174/40 CC |
| 8,337,225 | B2 * | 12/2012 | Bollmann | 439/212 |
| 8,480,414 | B2 * | 7/2013 | Carnevale et al. | 439/97 |

OTHER PUBLICATIONS

GE Industrial Systems, BuyLog Catalog, Updated Dec. 2012, 76 pp.
GE Industrial Systems, OEM Load Center Parts Program, 89 pp.

* cited by examiner

*Primary Examiner* — Hien Vu
(74) *Attorney, Agent, or Firm* — Eckert Seamans Cherin & Mellott, LLC; Brij K. Agarwal

(57) ABSTRACT

An improved connection apparatus is connectable with an elongated neutral bus to electrically connect a neutral conductor to the neutral bus. The connection apparatus is movable among any of a variety of positions along the neutral bus in order to facilitate connection of the various neutral conductors with the neutral bus at various desirable locations within an electrical enclosure. The connection apparatus is also advantageously removable from the neutral bus and is reinstallable thereon to facilitate changing the locations of the connections between the neutral conductors and the neutral bus and to avoid interference between any of a neutral connection, a connection apparatus, a neutral bus, and a circuit interrupter.

20 Claims, 15 Drawing Sheets

CONNECTION APPARATUS CONNECTABLE WITH NEUTRAL BUS

BACKGROUND

1. Field

The disclosed and claimed concept relates generally to electrical switchgear and, more particularly, to a connection apparatus that is connectable with a neutral bus in a switchgear enclosure.

2. Related Art

Electrical switchgear of numerous types is generally well understood in the relevant art with regard to numerous applications. In nearly all applications, electrical connections made by switchgear are contained within some type of an enclosure such as a load center, a breaker panel, and the like without limitation, in order to avoid unintended contact between exposed electrical conductors and people, by way of example. Some electrical enclosures include stabs that permit circuit interrupters and other devices to be connected with line and load conductors. Certain circuit interrupters additionally require a neutral connection and include a neutral wire that may be connected with a neutral conductor such as a neutral terminal block within the interior of the electrical enclosure. While such devices have been generally effective for their intended purposes, they have not been without limitation.

For instance, previously known neutral terminal blocks have typically been in the form of elongated strips of metal, such as aluminum or another conductor, having a plurality of holes formed therein that are structured to receive neutral wires, and further having a number of set screws that are employable to clamp the neutral wires to the neutral terminal blocks. Since electrical enclosures are available in a variety of sizes and configurations, however, difficulty has sometimes been encountered in trying to stretch a neutral wire from a circuit interrupter to a relatively small neutral terminal block. Other difficulties have been encountered because the neutral terminal block or the wires that are connected therewith have interfered with circuit interrupters, some of which are of varying sizes and shapes, that are sought to be installed in an electrical enclosure.

It thus would be desired to provide a solution that overcomes these and other shortcomings in the art.

SUMMARY OF THE INVENTION

In view of the foregoing, an improved connection apparatus is connectable with an elongated neutral bus to electrically connect a neutral conductor to the neutral bus. The connection apparatus is movable among any of a variety of positions along the neutral bus in order to facilitate connection of the various neutral conductors with the neutral bus at various desirable locations within an electrical enclosure. The connection apparatus is also advantageously removable from the neutral bus and is reinstallable thereon to facilitate changing the locations of the connections between the neutral conductors and the neutral bus and to avoid interference between any of a neutral connection, a connection apparatus, a neutral bus, and a circuit interrupter.

Accordingly, an aspect of the disclosed and claimed concept is to provide an improved connection apparatus that is usable with an elongated neutral bus and that is removable from the neutral bus and reinstallable thereon in order to facilitate varying the locations of the connections between neutral conductors and the neutral bus.

Another aspect of the disclosed and claimed concept is to provide an improved connection apparatus that is movable among any of a variety of positions along the longitudinal extent of an elongated neutral bus.

Another aspect of the disclosed and claimed concept is to facilitate the electrical connection of neutral conductors with one another within an electrical enclosure.

Accordingly, an aspect of the disclosed and claimed concept is to provide an improved connection apparatus that is structured to be installable on an elongated neutral bus and to be removable therefrom, the connection apparatus further being structured to enable a conductor to be electrically connected with the neutral bus when the connection apparatus is installed on the neutral bus. The connection apparatus can be generally stated as including a support and a compression element disposed on the support. The support can be generally stated as including at least a first engagement element structured to be engageable with the neutral bus. The support can be generally stated as further including at least a first connection element that extends between the compression element and the at least first engagement element. The compression element is structured to apply a compressive load to at least one of the neutral bus and the at least first engagement structure to electrically connect together the neutral bus and the conductor. The support has formed therein an elongated passage, the at least first engagement element and the at least first connection element being situated adjacent at least a portion of the passage, the passage having a first end opening at a first end of the support, a second end opening at a second end of the support opposite the first end, and a lateral opening that extends between and is in communication with the first and second end openings. The first and second end openings are structured to have at least a portion of the neutral bus extending therethrough when the connection apparatus is in a position installed on the neutral bus, the lateral opening being structured to have at least a portion of the neutral bus received therethrough in a direction at least in part transverse to the longitudinal extent of the neutral bus when the connection apparatus is moved between the position installed on the neutral bus and a position removed from the neutral bus.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
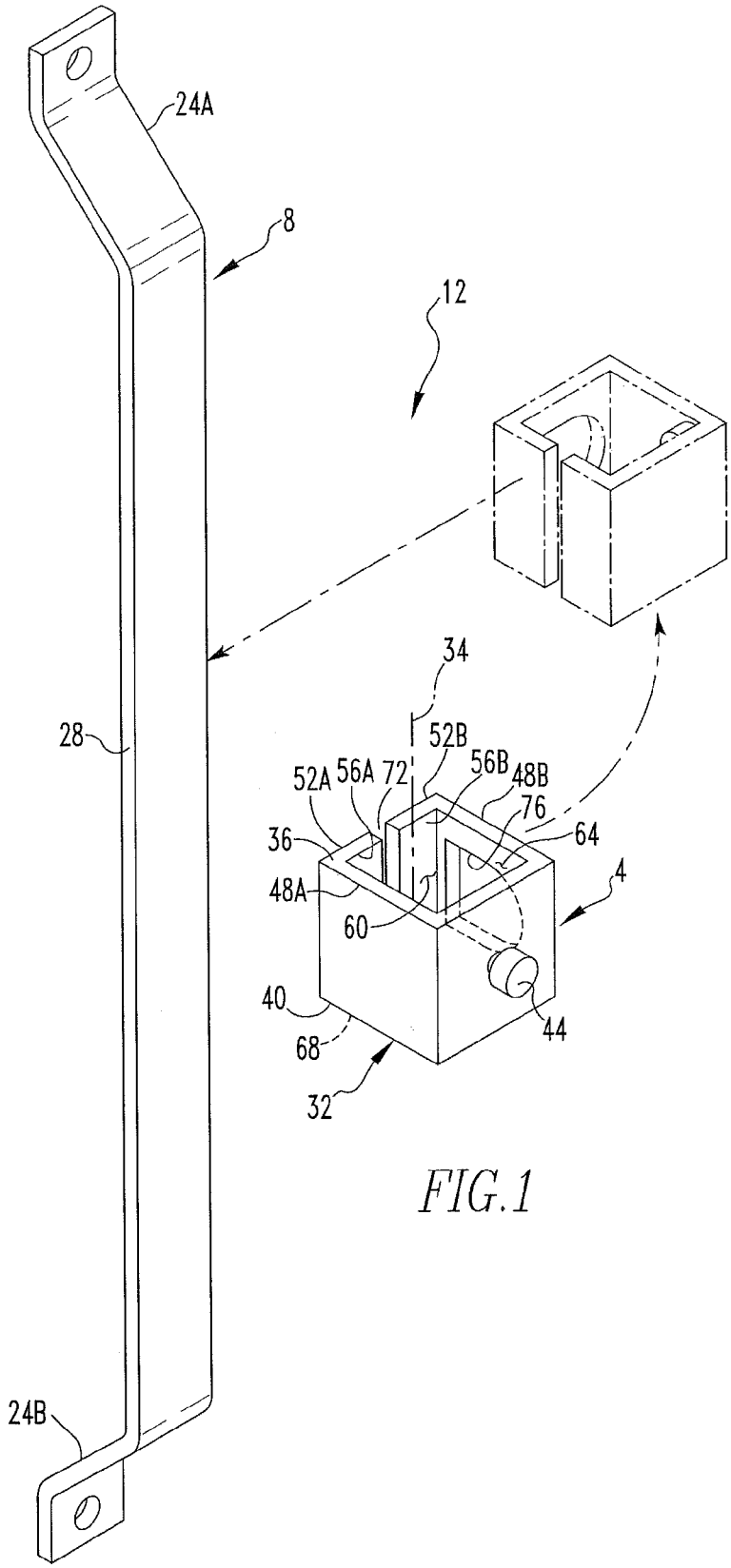
FIG. 1 is a perspective view of a connection apparatus in accordance with a first embodiment of the disclosed and claimed concept in a condition removed from an elongated neutral bus.

An improved connection apparatus 4 in accordance with a first embodiment of the disclosed and claimed concept is depicted in FIGS. 1-5 and is shown in FIG. 1 as being in a condition removed from an elongated neutral bus 8 that is also in accordance with the disclosed and claimed concept. The connection apparatus 4 and the neutral bus 8 can be said to together form an improved combination 12 in accordance with the disclosed and claimed concept. The neutral bus 8 is configured to be installed within an electrical enclosure such as a load center 16 as is depicted schematically in FIG. 2 in order to enable electrical connection between the neutral bus 8 and a number of electrical conductors that may be in the form of wires that form neutral conductors such as a neutral conductor 20A (FIGS. 2 and 3) and a neutral conductor 20B (FIG. 3) (collectively referred to herein with the numeral 20). As employed herein, the expression "a number of" and various thereof shall refer broadly to any non-zero quantity, including a quantity of one.

The neutral bus 8 can be said to include a pair of legs 24A and 24B (collectively referred to herein with the numeral 24) between which is disposed an intermediate element 28. The legs 24 are connectable with the load center 16 and are of an arcuate configuration that is intended to space the intermediate element 28 from the wall of the load center 16 to which the legs 24 are mounted. The neutral bus 8 may be formed of any appropriate conductor, such as aluminum or other material, and will likely have dimensions that are appropriate to the load carrying requirements of the load center 16. It is noted that while the neutral bus 8 and the conductors 20 are described herein in terms of being connected with an electrical neutral, it is understood that such terminology is not intended to be limiting, and it is expressly noted that such conductive elements could be employed in conjunction with an electrical ground or other electrical feature without departing from the present concept.

The connection apparatus 4 can be said to include an elongated support 32 that can generally be said to extend along a direction of elongation 34 between a first end 36 and a second end 40 that are opposite one another. The connection apparatus 4 can further be said to include a compression element 4 which, in the depicted exemplary embodiment, is in the exemplary form of a threaded set screw. As will be set forth in greater detail below, the compression element 44 is intended to apply a compressive load to electrically connect together the conductor 20 and the neutral bus 8, but any of a variety of compression elements different than those expressly depicted herein can be employed without departing from the present concept.

Figure 4:
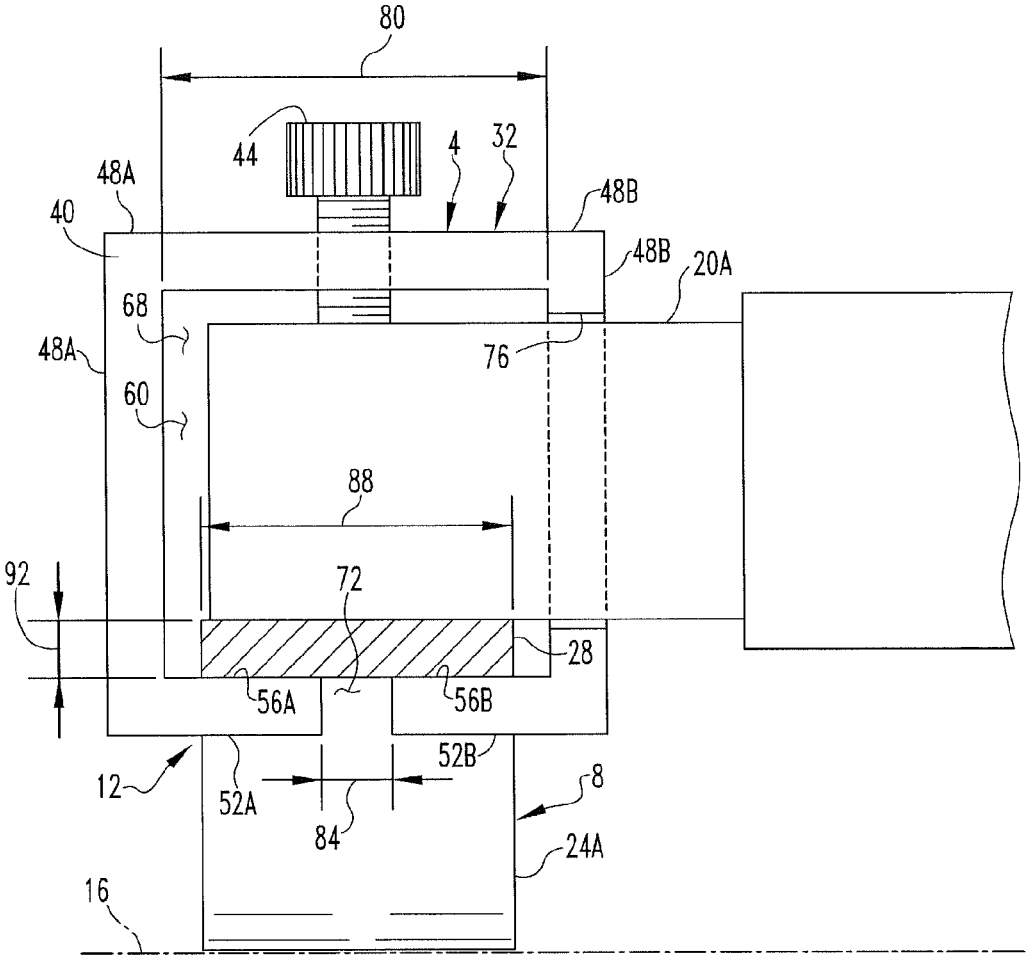
FIG. 4 is a sectional view as taken along line 4-4 of FIG. 2.

As can be understood from FIGS. 4 and 5, the support 32 can be said to include a pair of connection elements 48A and 48B (collectively referred to herein with the numeral 48) that are situated at opposite sides of the support 32 and that are engagable with the neutral bus 8 to resist rotation of the support 32 with respect to the neutral bus 8, such as during rotation and tightening of the compression element 44. The support 32 can be further said to include a pair of engagement elements 52A and 52B (collectively referred to herein with the numeral 52) that are situated on the connection elements 48 opposite the compression element 44. The connection elements 48 can thus be said to extend generally between the engagement elements 52 and the compression element 44. The engagement elements 52A and 52B each include an engagement surface 56A and 56B, respectively (collectively referred to herein with the numeral 56), that are coplanar with one another.

The support 32 can be formed in any of a variety of fashions and may, for example, be formed via stamping or other appropriate formation methodology. The support 32 and the compression element 44 may both be formed of steel or other appropriate conductive material, and the support 32 itself may be formed from sheet material that has a thickness of 3/32 inch or 1/8 inch, by way of example, although other materials and thicknesses can be employed depending upon the needs of the particular application.

The support 32 can also be said to have an elongated passage 60 formed therein that extends along the direction of elongation 34 and that includes a first end opening 64 and a second end opening 68 at the first and second ends 36 and 40, respectively, and that are therefore at opposite ends of the passage 60. The passage 60 can further be said to include a lateral opening 72 that extends between the first and second end openings 64 and 68 and that is in communication with the first and second openings 64 and 68. In the depicted exemplary embodiment, the lateral opening 72 is interposed between and situated adjacent the engagement elements 52 and can thus likewise be said to be generally opposite the compression element 44. It can also be seen that an access hole 76 through which the conductor 20 is receivable is formed in the connection element 48B. The access hole 76 is in communication with the passage 60.

It can be seen that the connection elements 48 and the engagement elements 52 are disposed adjacent the passage 60. It can further be seen that the engagement elements 52 are disposed at alternate sides of the lateral opening 72.

Figure 2:
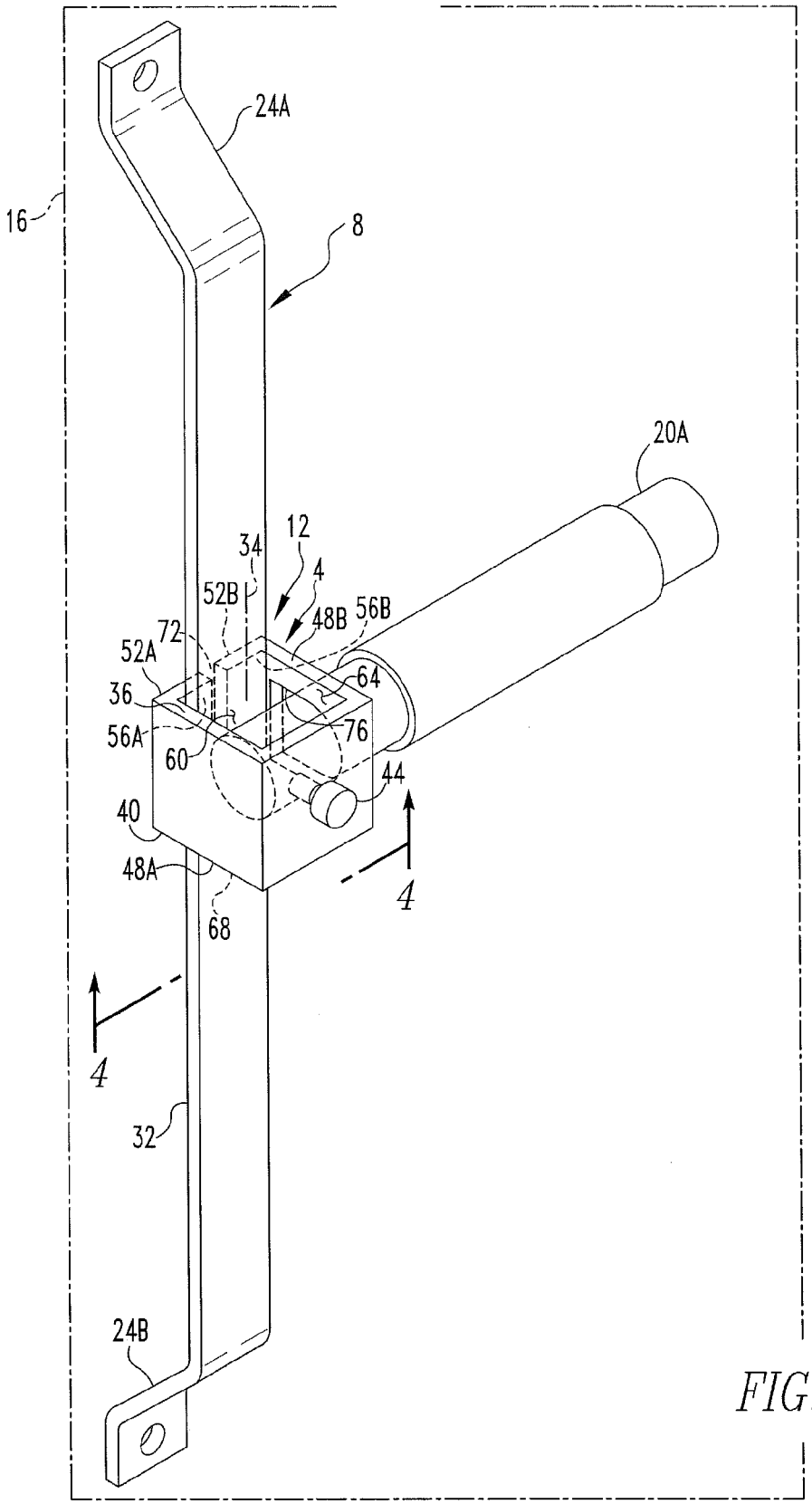
FIG. 2 is a view similar to FIG. 1, except depicting the connection apparatus installed on the neutral bus and electrically connecting the neutral bus and a neutral conductor.
Figure 3:
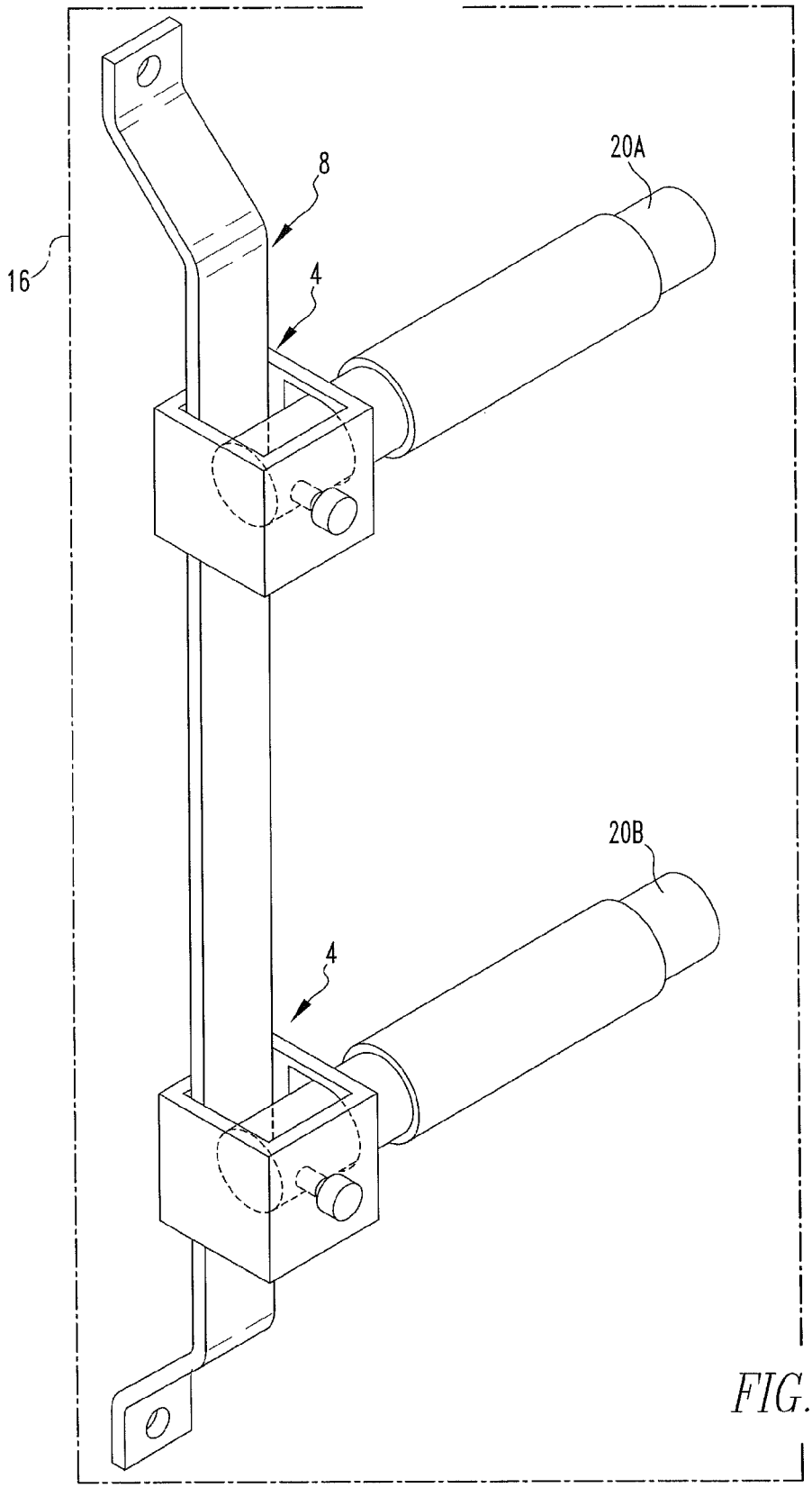
FIG. 3 is a view similar to FIG. 2, except depicting the connection apparatus connecting the neutral conductor to the neutral bus at another location thereon, and further depicting another connection apparatus connecting another neutral conductor with the neutral bus.

As set forth elsewhere herein, the connection apparatus 4 is depicted in FIG. 1 as being in a position removed from the neutral bus 8 but is depicted in FIGS. 2-4 as being in a position installed on the neutral bus 8 and connecting one of the conductors 20 with the neutral bus 8. FIG. 5 is intended to depict the connection apparatus 4 in an intermediate condition between a position installed on the neutral bus 8 and another position removed from the neutral bus 8 and includes arrows that depict movement of the connection apparatus 4 in a removal direction. When the connection apparatus 4 is installed on the neutral bus 8 and electrically connects to the neutral bus 8 one of the conductors 20, the compression element 44 can be seen to apply a compressive load to the conductor 20, which in turn applies a compressive load to the neutral bus 8, and which in turn applies a compressive load to the engagement element 52, while the connection elements 48 are in a state of tension, all of which enable the conductor 20 to be electrically connected with the neutral bus 8. Other interrelationships among such elements can exist without departing from the present concept.

When the connection apparatus 4 is installed on the neutral bus 8, the connection apparatus 4 is situated on the intermediate element 28. The intermediate element 28 extends along the direction of elongation 34 through the passage 60, passes through the first and second end openings 64 and 68, and is engaged with the engagement surfaces 56.

When installing the connection apparatus 4 on the neutral bus 8, the connection apparatus 4 can be moved to essentially any longitudinal position along the longitudinal extent of intermediate element 28, i.e., any position that is not already occupied by another connection apparatus 4. Such sliding is performed by ensuring that the compression element 44 is loosened and by longitudinally sliding the connection apparatus 4 along the intermediate element 28, with the intermediate element 28 being situated generally between the compression element 44 and the engagement elements 52.

It is noted, however, that the connection element 4 is also advantageously removable from the intermediate element 28 and is reinstallable thereon as needed. Such removal and reinstallation involves rotating the connection element 4 on the intermediate element 28, as in FIG. 5A, as well as receiving the intermediate element 28 through the lateral opening 72 in a direction transverse to the longitudinal extent of the intermediate element 28, as in FIG. 5B. The receiving of the intermediate element through the lateral opening 72 of the connection element 4 is also transverse to the direction of elongation 34. Thus, when the connection apparatus 4 is in the installed position on the neutral bus 8, the intermediate element 28 can be said to extend through the first and second end openings 64 and 68. In moving the connection apparatus 4 between the installed position of FIG. 4 and a position removed from the neutral bus 8, the connection apparatus 4 can be said to be moved with respect to the intermediate element 28 in a direction transverse to the longitudinal extent of the intermediate element 28.

Figure 5A:
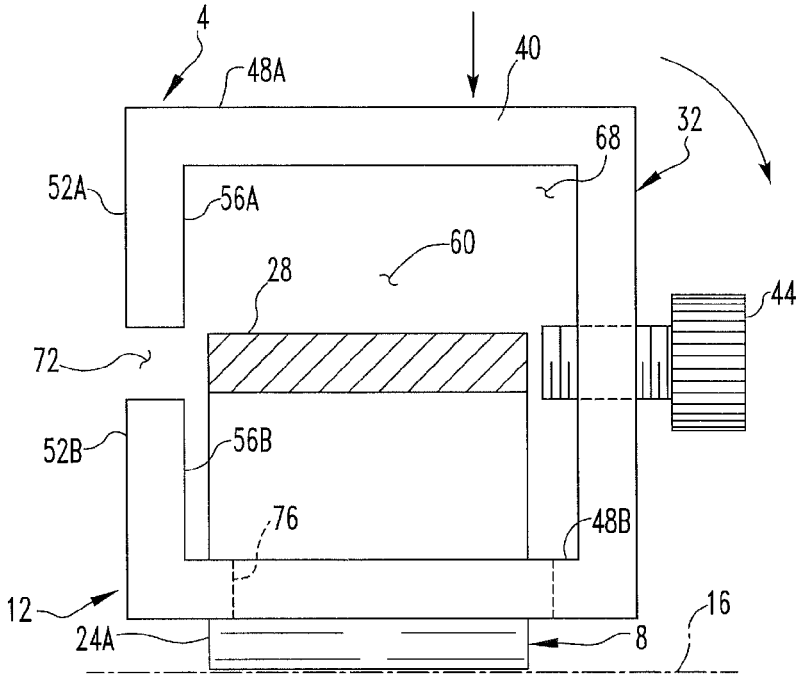
FIG. 5A is a view similar to FIG. 4, except depicting the connection apparatus rotated with respect to the neutral bus.
Figure 5B:
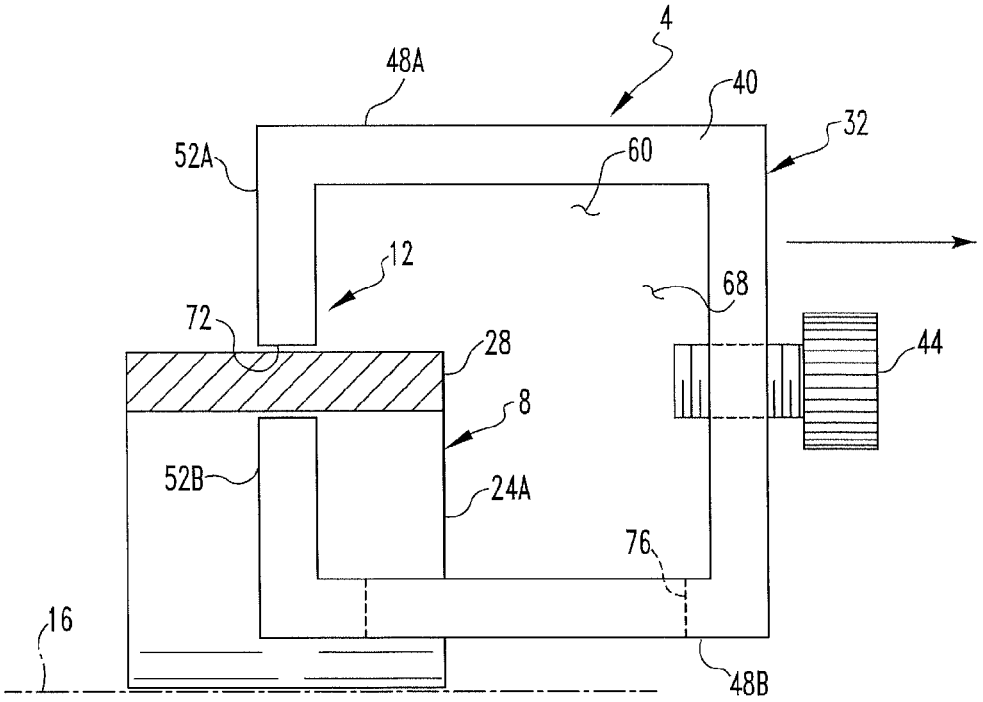
FIG. 5B is a view similar to FIG. 5A, except depicting the connection apparatus being removed from the neutral bus by translating the connection apparatus with respect to the neutral bus.

Movement of the connection apparatus 4 from the installed position toward the removed position is depicted in FIGS. 5A and 5B. In FIG. 5A, the connection apparatus 4 is depicted as having had the conductor 20 removed therefrom after loosening of the compression element 44. Further in FIG. 5A, the connection apparatus 4 has been translated in a downward direction from the perspective of FIG. 5A to disengage the engagement elements 52 from the intermediate portion 32. The connection apparatus 4 is additionally depicted in FIG. 5A as having been rotated (in an exemplary clockwise direction from the perspective of FIG. 5A) through an angle of approximately ninety degrees about an axis parallel with the direction of elongation 34 to cause an edge of the intermediate element 28 to be aligned with the lateral opening 72. The connection apparatus 4 can then be translated in the direction indicated by the arrow in FIG. 5B to receive the intermediate element 28 in a direction transverse to its longitudinal extent through the lateral opening 72 to cause the connection apparatus 4 to be removed from the neutral bus 8. Installation of the connection apparatus 4 on the neutral bus 8 is the opposite of its removal.

As can be understood from FIG. 4, the connection elements 48 can be said to be spaced apart from one another by a support width 80, and the engagement elements 52 can be said to be spaced apart from one another by a slot width 84. That is, the lateral opening 72 is interposed between the engagement elements 52, and the width of the lateral opening 72 between the engagement elements 52 is the sloth width 84. It can also be seen that the neutral bus 8 is of a bus width 88 and a bus thickness 92 that are in directions orthogonal to one another and to the direction of elongation of the intermediate element 28. In the depicted exemplary embodiment, the support width 80 is greater than both the bus width 88 and the bus thickness 92. It can also be seen that the slot width 84 is greater than the bus thickness 92 but is less than the bus width 88. In an embodiment wherein the neutral bus 8 is formed of aluminum and is to have a predetermined current carrying capacity, the bus width 88 may be on the order of ⅜ inch, and the bus thickness 92 may be on the order of 1/16 inch, although other dimensions can be employed without departing from the present concept.

It thus can be seen that the connection apparatus 4 can be installed on the neutral bus 8 to electrically connect the conductor 20 with the neutral bus 8 at any of a wide variety of locations along the longitudinal extent of the intermediate element 28. In this regard, the connection apparatus 4 can be repositioned along the longitudinal extent of the intermediate element 28 by sliding the connection element 4 along the intermediate element 28, by removal and installation of the connection apparatus 4 with respect to the intermediate element 28, or both depending upon the needs of the particular application. Moreover, a plurality of the connection apparatuses 4 can be employed as is depicted in FIG. 3 to connect the plurality of the conductors 20 at desired locations along the intermediate element 28. Furthermore, the connection apparatus 4 can be removed from the intermediate element 28 and repositioned at a different location thereon in order to avoid interference between it and, by way of example, a circuit interrupter within the load center 16.

An improved connection apparatus 104 in accordance with a second embodiment of the disclosed and claimed concept is depicted generally in FIGS. 6-9 in connection with an elongated neutral bus 108. The neutral bus 108 is substantially identical to the neutral bus 8, although it need not be. The connection apparatus 104 and the neutral bus 108 can be said to together from a combination 112 in accordance with the disclosed and claimed concept. As before, the neutral bus 108 can be installed in a load center 116 or other appropriate structure, and the connection apparatus 104 installed thereon to electrically connect together a neutral conductor 120 with the neutral bus 108.

The connection apparatus 104 is similar to the connection apparatus 4 in that the connection apparatus 104 includes an elongated support 132 that extends between a first end 136 and a second end 140. The connection apparatus 104 further include a compression element 144 situated on the support 132 that is in the exemplary form of a threaded set screw. However, the support 132 in the depicted exemplary embodiment includes only a single connection element 148 and a single engagement element 152, with the connection element 148 extending generally between the compression element 144 and the engagement element 152. The support 132 further includes an alignment element 154 that is situated on the engagement element 152 opposite the connection element 148. The alignment element 154 and the connection element 148 both are engagable with the neutral bus 108 to resist rotation of the support 132 with respect to the neutral bus 108 such as during tightening and loosening of the compression element 144.

The support 132 has an elongated passage 160 formed therein that extends between a first end opening 164 and a second end opening 168. The passage 160 additionally includes a lateral opening 172 that extends between the first and second end openings 164 and 168 and that is in communication therewith.

In the connection apparatus 104, however, the lateral opening 172 is situated adjacent the alignment element 154 and is opposite the connection element 148. Moreover, the connection element 148, the engagement element 152, and the alignment element 154 are all situated adjacent the passage 160. The connection element 148 has an access hole 176 formed therein through which the conductor 120 is receivable when the conductor 120 is intended to be connected with the neutral bus 108 through installation of the connection apparatus 104 thereon.

The support 132 can be said to be of a support width 180 which is the distance between the connection element 148 and the alignment element 154. In the depicted exemplary embodiment, the support width 180 is depicted as being only slightly wider than the bus width 188 for reasons that will be set forth in greater detail below. The lateral opening 172 is disposed adjacent the alignment element 154 and extends generally between the alignment element 154 and an additional leg 186 of the connection element 148. The lateral opening 172 is of a slot width 184 that is greater than the bus thickness 192 but that is (in the depicted exemplary embodiment) less than the bus width 188.

Figure 6:
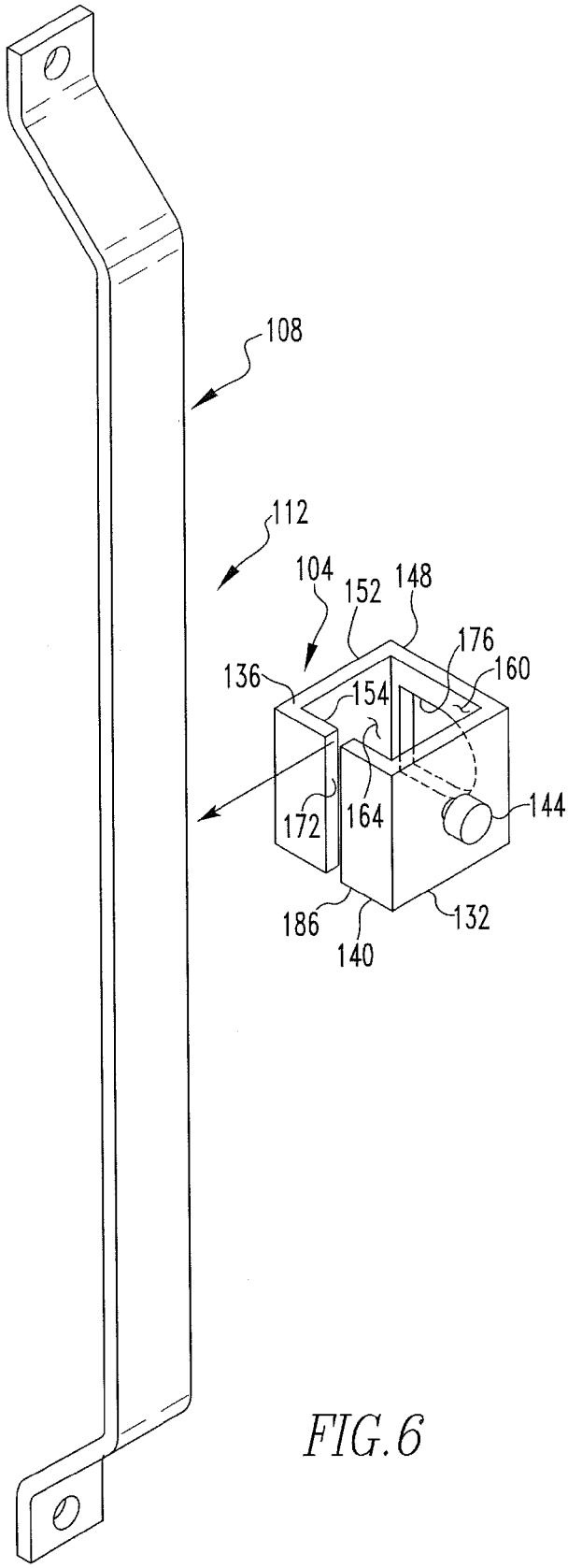
FIG. 6 is a perspective view of an improved connection apparatus in accordance with a second embodiment of the disclosed and claimed concept in a position removed from an elongated neutral bus.
Figure 7:
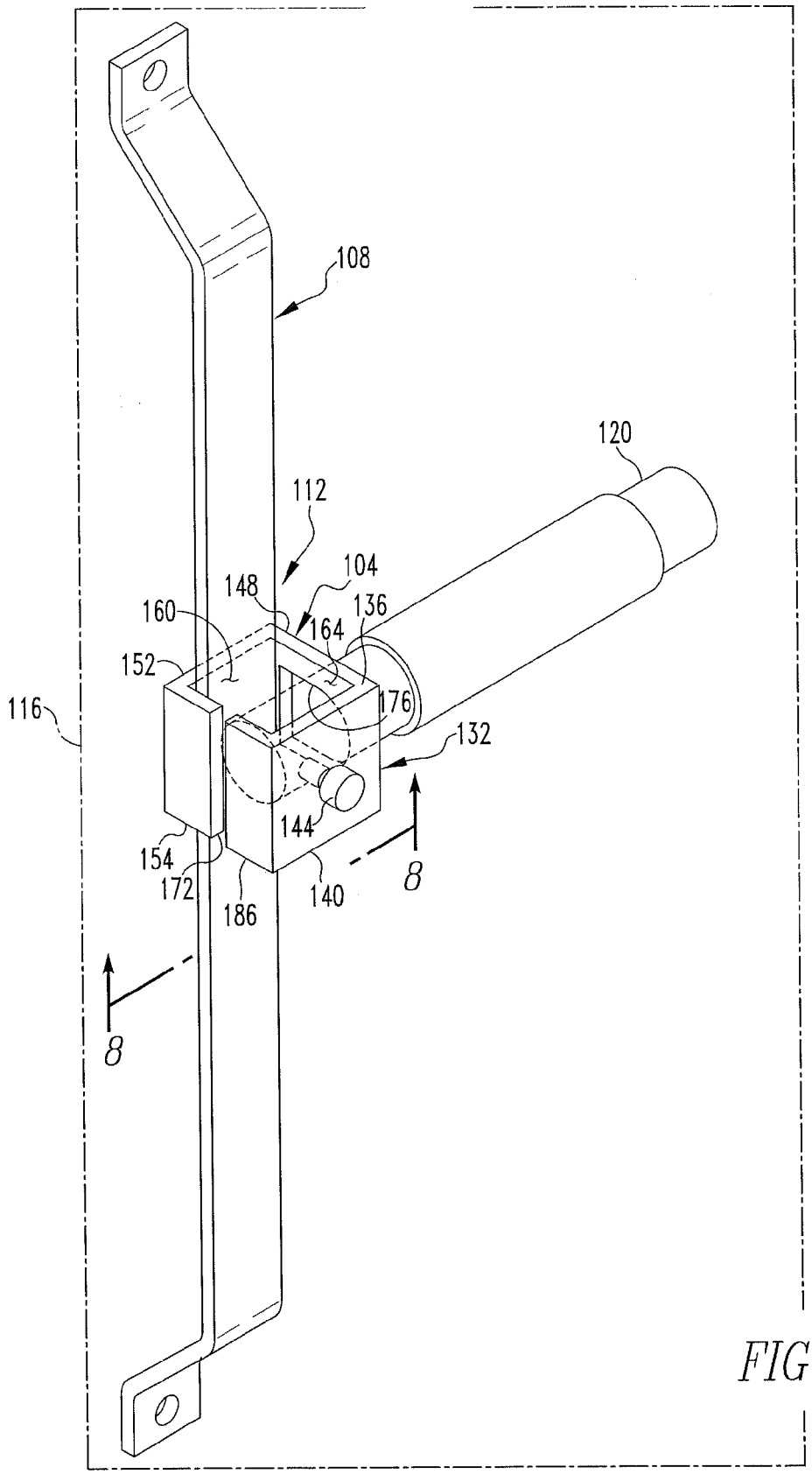
FIG. 7 is a view similar to FIG. 6, except depicting the connection apparatus of FIG. 6 installed on the neutral bus and electrically connecting a neutral conductor with the neutral bus.
Figure 8:
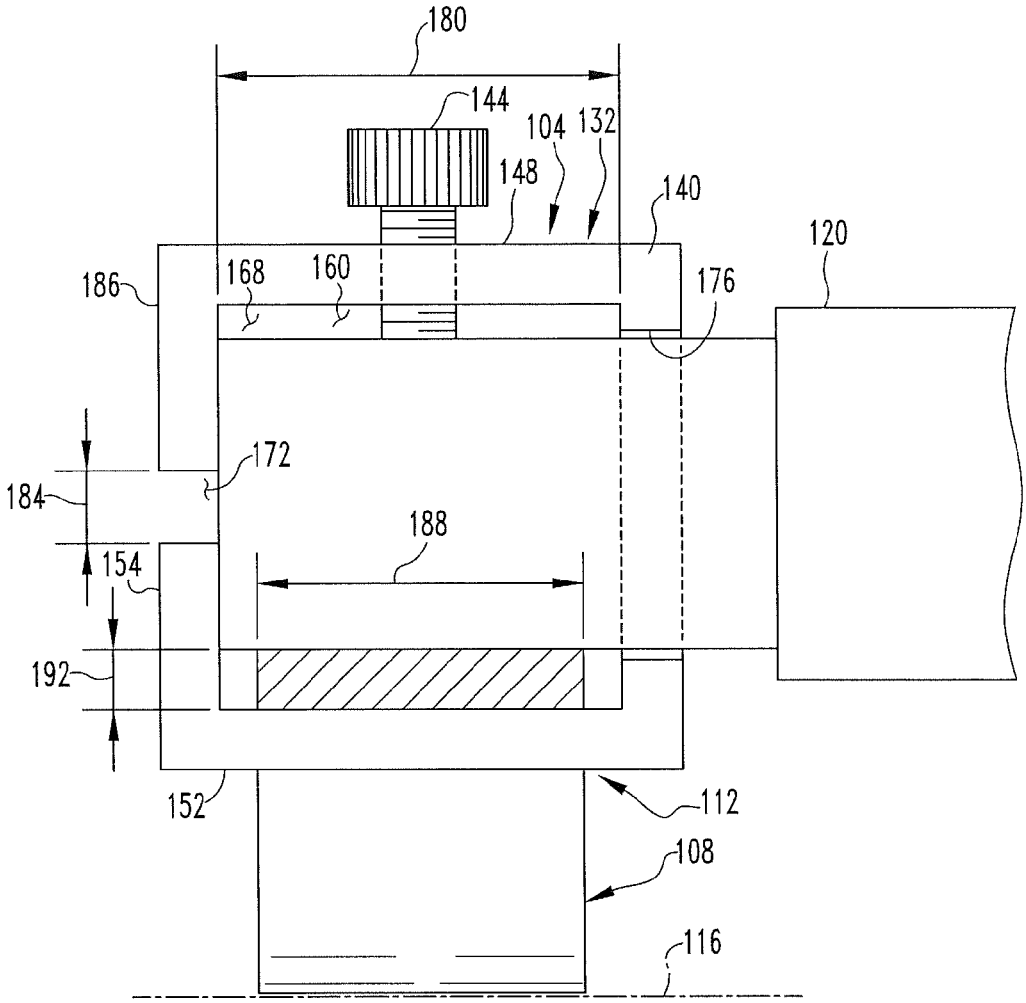
FIG. 8 is a sectional view as taken along line 8-8 of FIG. 7.
Figure 9:
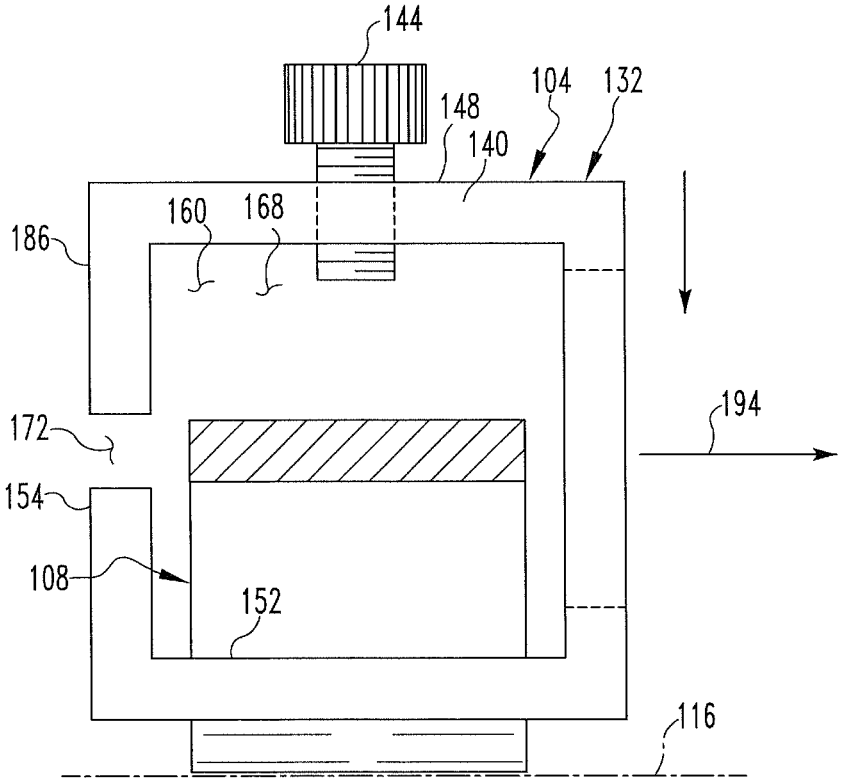
FIG. 9 is a view similar to FIG. 8, except depicting the connection apparatus of FIG. 7 being removed from the neutral bus.

In moving the connection apparatus 104 between a position removed from the neutral bus 108, as in FIG. 6, and an installed position on the neutral bus 108, as in FIGS. 7 and 8, the connection apparatus 104 typically is not rotated with respect to the neutral bus 108 and rather is translated with respect thereto as is indicated with the arrows in FIG. 9. That is, FIG. 9 depicts the connection apparatus 104 moving in a removal direction, indicated with an arrow 194, whereby the engagement element 152 is removed from its engagement with the neutral bus 108 to cause the engagement element 152 and the neutral bus 108 to be spaced apart, and to cause an edge of the neutral bus 108 to become aligned with the lateral opening 172. The connection apparatus 104 can then be translated in a direction orthogonal to the removal direction 194 to cause the neutral bus 104 to be moved in a direction transverse to its longitudinal extent through the lateral opening, whereby the connection apparatus 104 is removed from the neutral bus 108. Installation is performed in an opposite fashion.

The support width 180 is depicted as being only slightly wider than the bus 188, i.e., mainly wide enough to accommodate the neutral bus 108 between the connection element 148 and the alignment element 154, because the connection apparatus 104 need not be rotated in the fashion of the connection apparatus 4 in order to remove it from the neutral bus 108 or to install it thereon. The connection apparatus 104 thus provides many of the benefits of the connection apparatus 4 while providing even simpler installation and removal onto and from the neutral bus 108.

Figure 10:
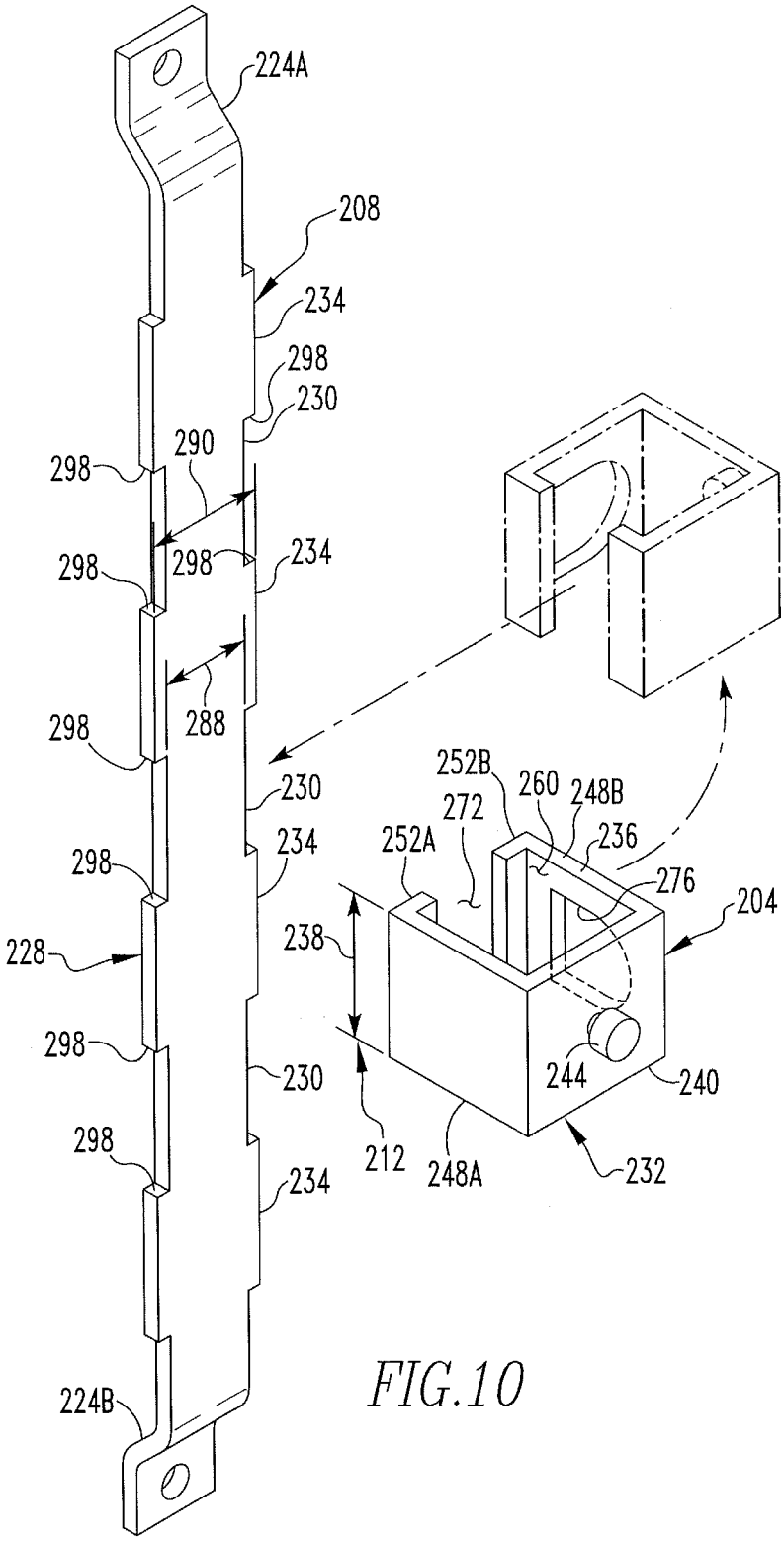
FIG. 10 is a perspective view of an improved connection apparatus in accordance with a third embodiment of the disclosed and claimed concept in a condition removed from an elongated neutral bus in accordance with the disclosed and claimed concept.
Figure 11:
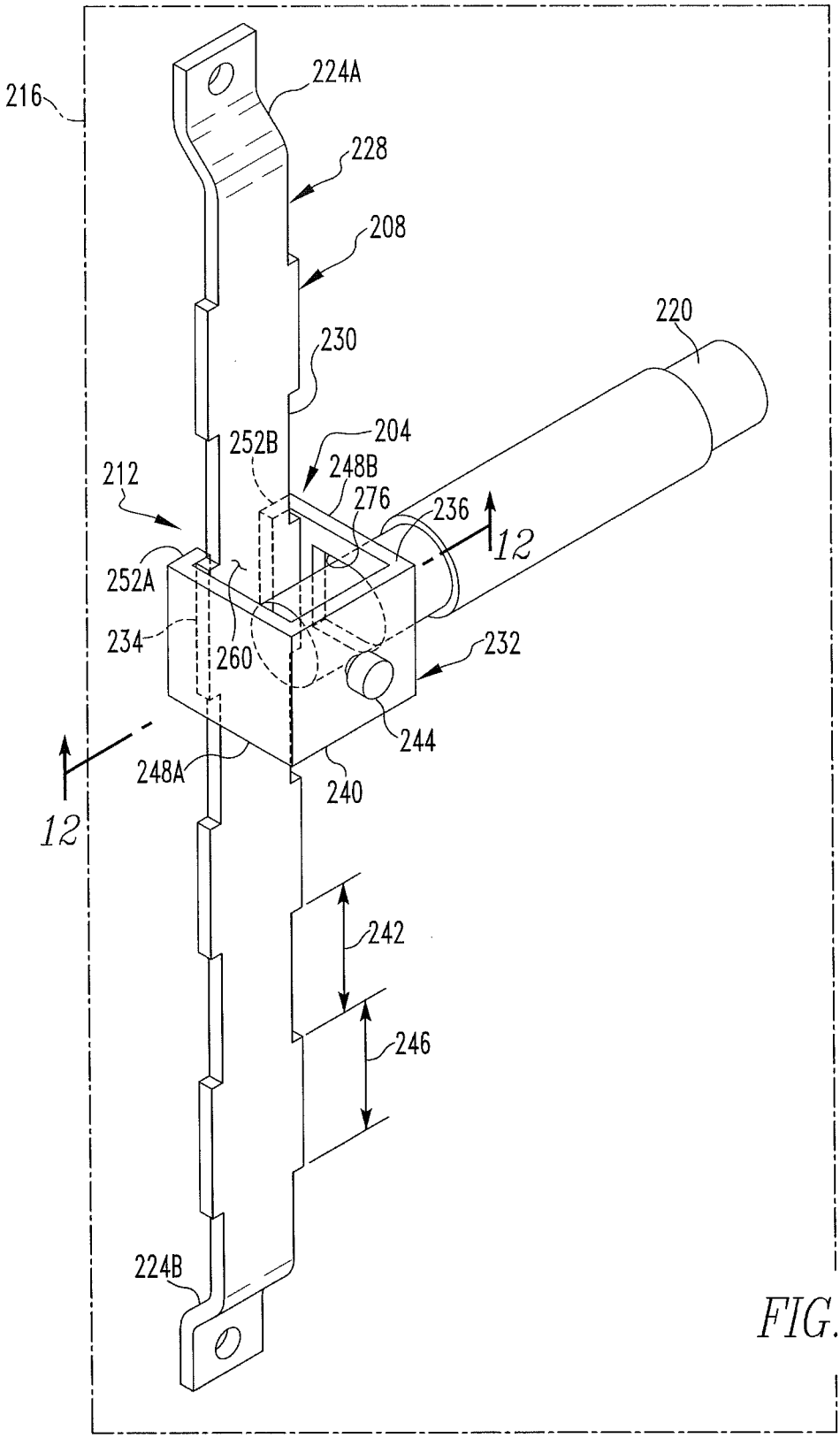
FIG. 11 is a view similar to FIG. 10, except depicting the connection apparatus installed on the neutral bus and electrically connecting a neutral conductor with the neutral bus.

An improved connection apparatus 204 in accordance with a third embodiment of the disclosed and claimed concept is depicted generally in FIGS. 10-15 in connection with a neutral bus 208. The connection apparatus 204 and the neutral bus 208 together can be said to form a combination 212 in accordance with the disclosed and claimed concept. As before, the neutral bus 208 can be installed in a load center 216, and the connection apparatus 204 is installable on the neutral bus 208 in order to electrically connect with it a neutral conductor 220. The neutral bus 208 includes a pair of legs 224A and 224B between which is an intermediate element 228. The intermediate element 228 is formed from a plurality of relatively narrower portions 230 that are positioned alternately with a plurality of relatively wider portions 234. The intermediate element 228 further includes one or more steps 298 at the junction between each adjacent pair of relatively narrower and relatively wider portions 230 and 234, with the steps 298 being depicted herein as oriented substantially orthogonal to the longitudinal extent of the intermediate portion 228. As is shown in FIG. 11, the relatively narrower portions 230 are of a first length 242 as measured along the longitudinal extent of the intermediate portion 228, and the relatively wider portions 234 are of a second length 246 as measured along the longitudinal extent of the intermediate portion 228.

The connection apparatus 204 is similar in appearance to connection apparatus 4 in that it includes a support 232 and a compression element 244 disposed thereon, with the support 232 including a pair of mirror image connection elements 248A and 248B that extend between the compression element 244 and a pair of engagement elements 252A and 252B. The connection apparatus 204 also has a first end 236 and a second end 240 opposite one another and, as is shown in FIG. 10, has a connector length 238 that is measured between the first and second ends 236 and 240. The connector length 238 is less than the first length 242 of the relatively narrower portions 230 to facilitate installation and removal of the connection apparatus 204 onto and from the intermediate portion 228 at the relatively narrower portions 230 thereof, as will be described in greater detail below.

The support 232 likewise includes a passage 260 formed therein that extends between a pair of openings at the opposite ends of the support 232 and that further includes a lateral opening 272 in a fashion similar to the connection apparatus 2. Also, the support 232 has an access hole 276 formed therein to permit a conductor to be receive therethrough and to be electrically connected with the neutral bus 208.

While the neutral bus 208 is of a bus thickness 292 that is substantially the same as the bus thicknesses 92 and 192, and while the narrower portions 230 are of a narrow bus width 288 that is substantially similar to the bus widths 88 and 188, it is noted that the wider portions 234 are of a wider bus width 290 that is greater than the narrow bus width 288. That is, the transverse dimensions of the neutral bus 208 that include the narrow bus width 288 and the bus thickness 292 are at least about the same as the comparable dimensions on the neutral buses 8 and 108 in order to avoid sacrificing current carrying capability. In order to accommodate the wider bus width 290 and to facilitate installation and removal of the connection apparatus 204 onto an from the neutral bus 208, the connection apparatus 204 is generally larger than the connection apparatus 4.

In particular, the support width 280 is slightly greater than the wider bus width 290 but, in the depicted exemplary embodiment, the connection apparatus 204 has a slot width 284 that is only slightly smaller than the narrow bus width 288. Such an arrangement of dimensions between the support width 280, the slot width 284, the narrow bus width 288, and the wider bus width 290 facilitates installation and removal of the connection apparatus 204 onto and from the neutral bus 208 and provides for a high compressive load to be provided by the compression element 244.

Figure 12:
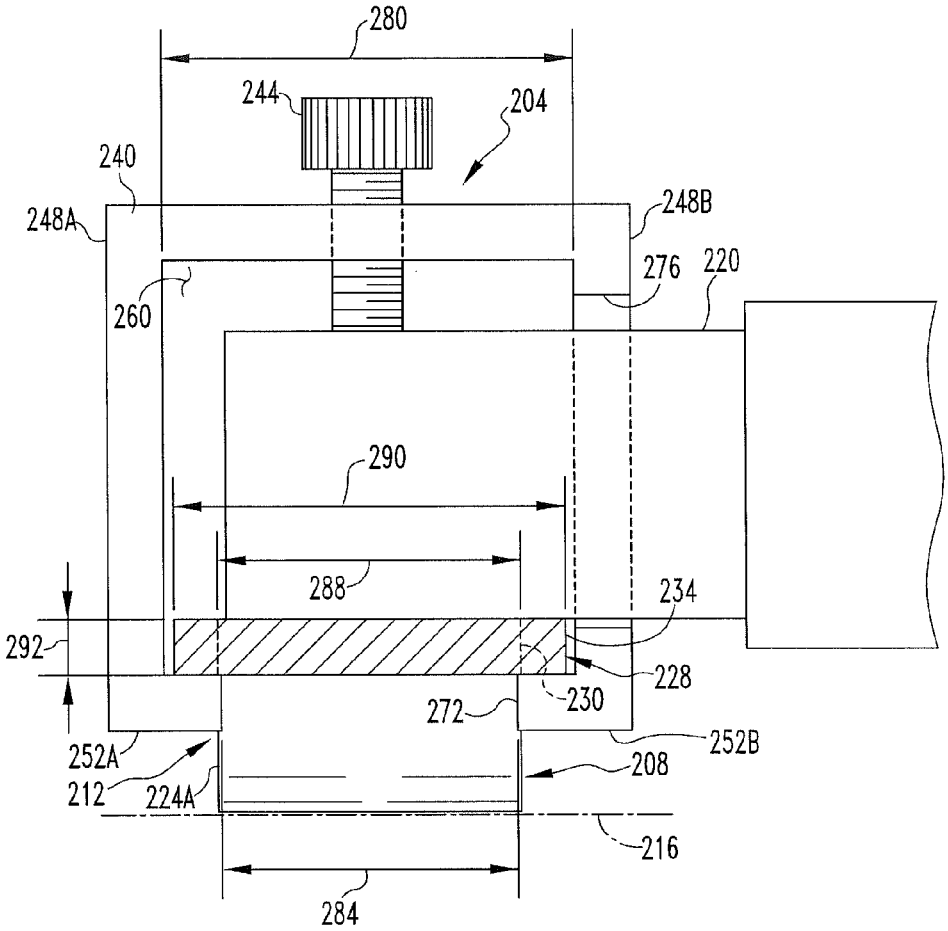
FIG. 12 is a sectional view as taken along line 12-12 of FIG. 11.

In particular, the connection apparatus 204 is typically installed on the neutral bus 204 at one of the wider portions 234, i.e., as is depicted generally in FIGS. 11 and 12. To remove the connection apparatus 204 from the neutral bus 208, the compression element 244 is loosened and the connection apparatus 204 is translated in a direction along the longitudinal extent of the intermediate element 228 until a narrower portion 230 is received in the passage 260, as is depicted generally in FIGS. 13 and 14. Since the narrow bus width 288 is slightly greater than the slot width 284, the engagement elements 252A and 252B retain the connection apparatus 204 on the intermediate element 228. In this regard, it is noted that in other embodiments the connection apparatus 204 can be formed with a slot width that is slightly greater than the narrow bus width 288, which would enable the connection apparatus 204 to be removed from the neutral bus 208 from its position depicted generally in FIG. 13 by pulling the connection apparatus 204 in a direction generally away from the neutral bus 208, which is in a direction generally out of the plane of the page of FIG. 13.

Figure 13:
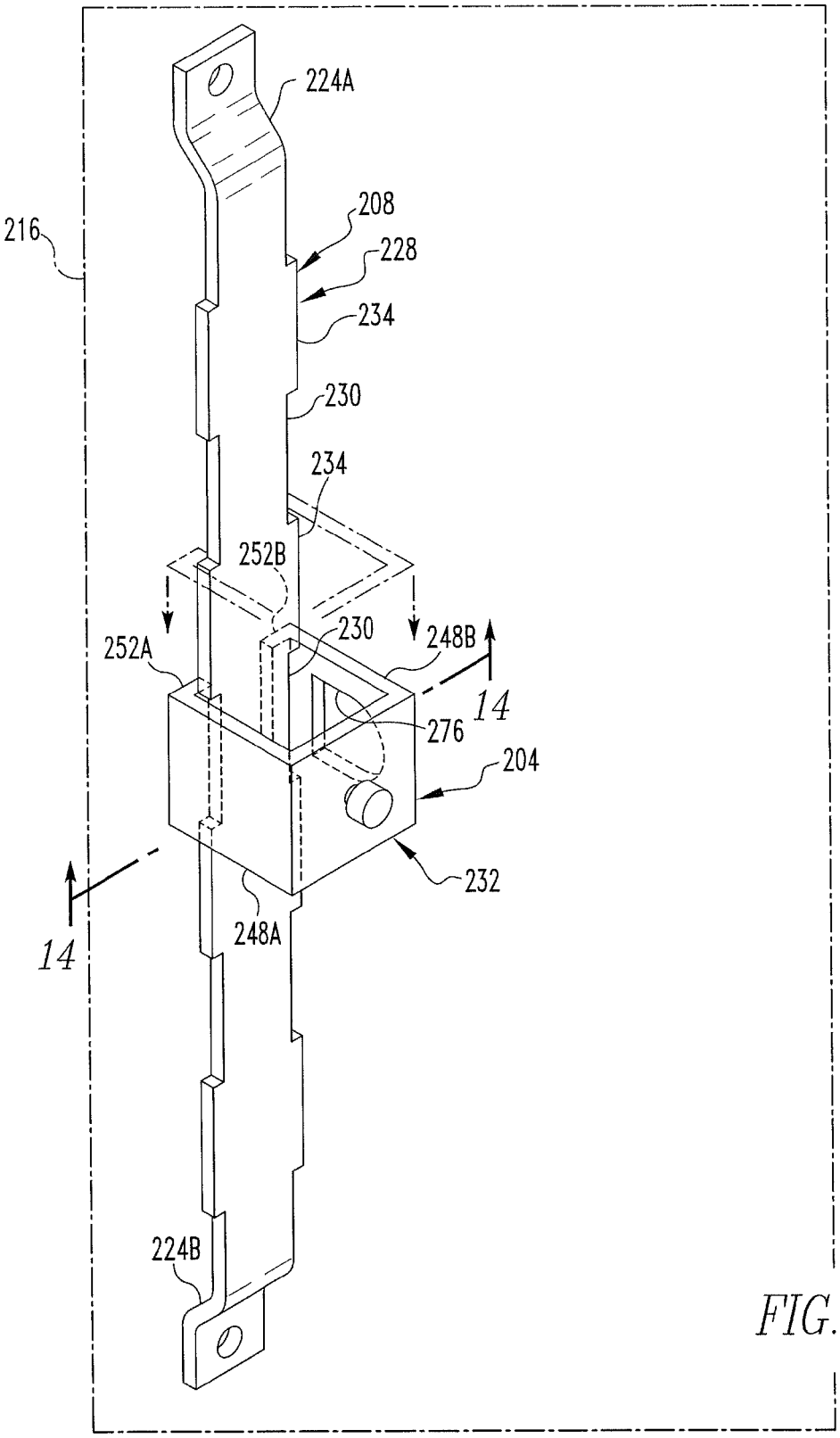
FIG. 13 is a view similar to FIG. 11, except depicting the connection apparatus being moved from the position of FIG. 11 (wherein the connection apparatus is installed on the neutral bus) to an intermediate position during the process of removing the connection apparatus from the neutral bus.
Figure 14:
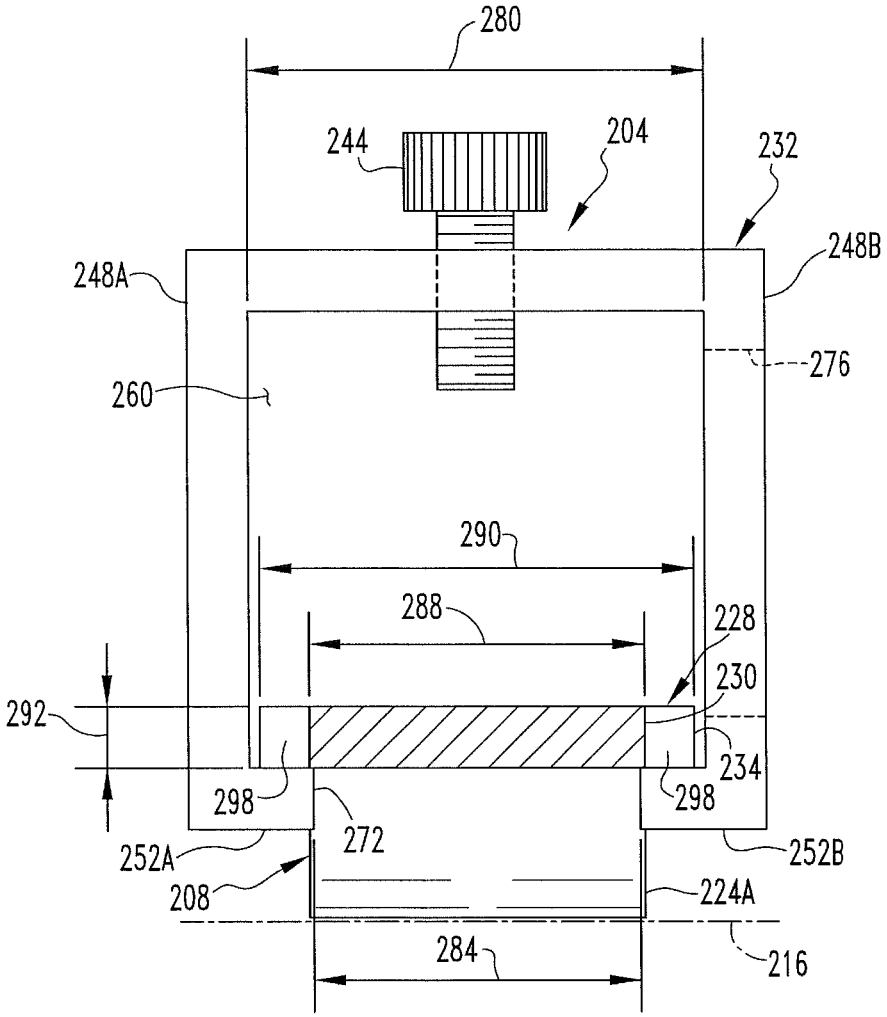
FIG. 14 is a sectional view as taken along line 14-14 of FIG. 13.
Figure 15:
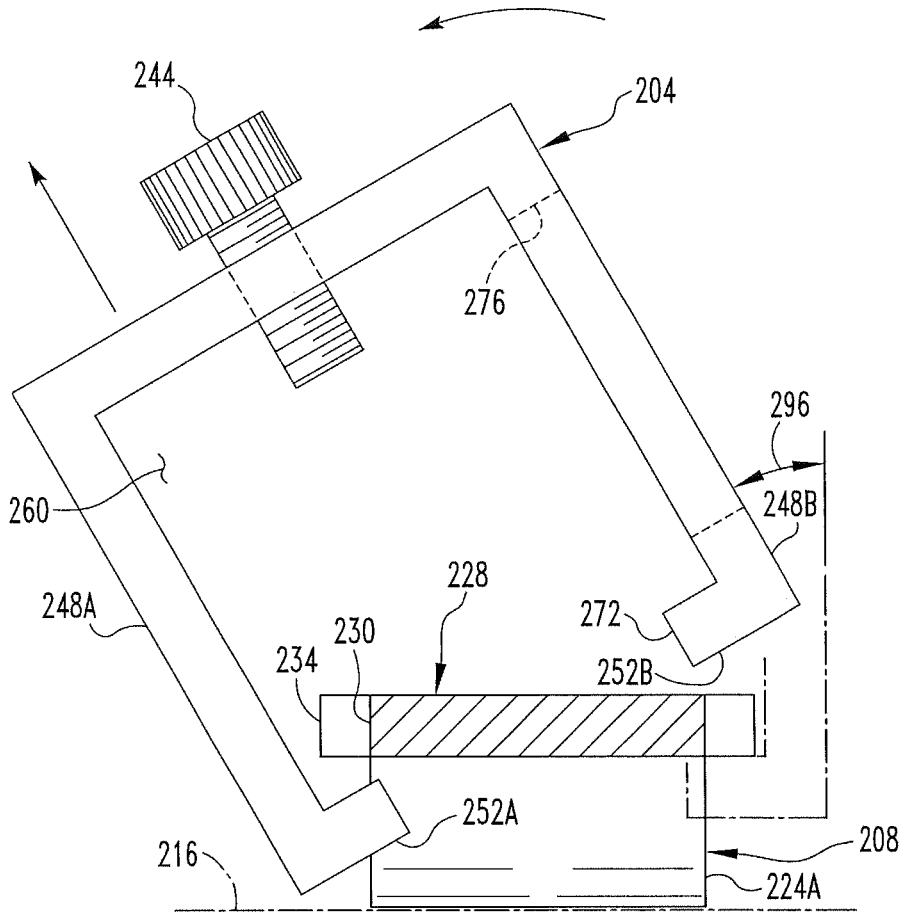
FIG. 15 is a view similar to FIG. 14, except depicting the connection apparatus in a further stage of the process of removing the connection apparatus from the neutral bus.

In the depicted exemplary embodiment, however, the connection apparatus 204 in its position in FIGS. 13 and 14 is pivoted about an axis that is parallel with the longitudinal extent of the intermediate element in order to cause the lateral opening 272 to be positioned to receive the narrow portion 230 therethrough in a direction transverse to the longitudinal extent of the intermediate element 228, as is depicted generally in FIG. 15. In the depicted exemplary embodiment, the relationship between the slot width 284, the narrow bus width 288, and the bus thickness 292 is such that a rotation of the connection apparatus 204 in the aforementioned fashion through an angle of rotation 296 that is at most about forthfive degrees and, even more advantageously, at most about thirty degrees, causes the alignment between the lateral opening 272 and the narrow portion 230 that is depicted generally in FIG. 15. The connection apparatus 204 can then be translated in the direction of the arrow indicated generally in FIG. 15 to move the connection apparatus 204 to a position removed from the neutral bus 208. Installation on the neutral bus 208 is performed by reversing the aforementioned operations.

Whereas the connection apparatus 4 needed to be rotated through an angle of approximately ninety degrees to enable it to be removed from the neutral bus 8, as in FIGS. 5A and 5B, the connection apparatus 204 can be configured to enable its removal with a much lesser rotation, as is depicted generally in FIG. 15. The wider portion 234 received in the passage 260 is overlapped by the engagement elements 252A and 252B in the installed position of the connection apparatus 204 to such an extent that even greater compressive forces can be imparted by the compression element 244 onto to the neutral conductor 220, the intermediate element 228 (i.e., at the wider portion 234), and the engagement elements 252A and 252B than would typically be possible with the connection apparatus 4.

It thus can be seen that the connection apparatuses 4, 104, and 204 are easily adjustable and are installable onto and removable from the neutral buses 8, 108, and 208, respectively, which facilitates the electrical connection of the various neutral conductors 20, 120, and 220 therewith. Other advantage will be apparent to one of ordinary skill in the relevant art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A connection apparatus structured to be installable on an elongated neutral bus and removable therefrom, the connection apparatus further being structured to enable a conductor to be electrically connected with the neutral bus when the connection apparatus is installed on the neutral bus, the connection apparatus comprising:
- a support;
- a compression element disposed on the support;
- the support comprising at least a first engagement element structured to be engageable with the neutral bus;
- the support further comprising at least a first connection element that extends between the compression element and the at least first engagement element;
- the compression element being structured to apply a compressive load to at least one of the neutral bus and the at least first engagement element to electrically connect together the neutral bus and the conductor;
- the support having formed therein an elongated passage, the at least first engagement element and the at least first connection element being situated adjacent at least a portion of the passage, the passage having:
  - a first end opening at a first end of the support,
  - a second end opening at a second end of the support opposite the first end, and
  - a lateral opening that extends between and is in communication with the first and second end openings; and
- the first and second end openings being structured to have at least a portion of the neutral bus extending therethrough when the connection apparatus is in a position installed on the neutral bus, the lateral opening being structured to have at least a portion of the neutral bus received therethrough in a direction at least in part transverse to the longitudinal extent of the neutral bus and the support being structured to be rotated with respect to the neutral bus when the connection apparatus is moved between the position installed on the neutral bus and a position removed from the neutral bus.

2. The connection apparatus of claim 1 wherein the support further has formed therein an access hole in communication with the passage that is structured to receive the conductor therethrough when the conductor is electrically connected with the neutral bus.

3. The connection apparatus of claim 2 wherein the access hole is formed in the at least first connection element.

4. The connection apparatus of claim 1 wherein the compression element is situated on the support opposite the at least first engagement element.

5. The connection apparatus of claim 1 wherein the support further comprises an alignment element disposed on the at least first engagement element and situated opposite the at least first connection element, the alignment element being structured to be engageable with the neutral bus to resist rotation of the support with respect to the neutral bus.

6. The connection apparatus of claim 5 wherein the alignment element is situated adjacent the lateral opening.

7. The connection apparatus of claim 1 wherein the support further comprises a second engagement element structured to be engageable with the neutral bus and a second connection element that extends between the compression element and the second engagement element, the at least first and second connection elements being situated on opposite sides of the support and each extending generally between the first and second ends of the support.

8. The connection apparatus of claim 7 wherein the at least first engagement element has a first engagement surface that is structured to be engaged with the neutral bus, and wherein the second engagement element has a second engagement surface that is structured to be engaged with the neutral bus, the first and second engagement surfaces being coplanar.

9. The connection apparatus of claim 7 wherein the lateral opening is interposed between the at least first and second engagement elements.

10. The connection apparatus of claim 7 wherein the compression element is disposed on the support opposite the at least first and second engagement elements.

11. A combination comprising:

a connection apparatus of claim 1; and an elongated neutral bus, the connection apparatus being structured to be installable on the neutral bus and removable therefrom, the connection apparatus further being structured to enable a conductor to be electrically connected with the neutral bus when the connection apparatus is installed on the neutral bus;

the connection apparatus comprising:

a support;

a compression element disposed on the support;

the support comprising at least a first engagement element structured to be engageable with the neutral bus;

the support further comprising at least a first connection element that extends between the compression element and the at least first engagement element;

the compression element being structured to apply a compressive load to at least one of the neutral bus and the at least first engagement element to electrically connect together the neutral bus and the conductor;

the support having formed therein an elongated passage, the at least first engagement element and the at least first connection element being situated adjacent at least a portion of the passage, the passage having:

a first end opening at a first end of the support, a second end opening at a second end of the support opposite the first end, and a lateral opening that extends between and is in communication with the first and second end openings;

the first and second end openings being structured to have at least a portion of the neutral bus extending therethrough when the connection apparatus is in a position installed on the neutral bus, the lateral opening being structured to have at least a portion of the neutral bus received therethrough in a direction at least in part transverse to the longitudinal extent of the neutral bus when the connection apparatus is moved between the position installed on the neutral bus and a position removed from the neutral bus.

12. The combination of claim 11 wherein the neutral bus comprises a pair of legs and an intermediate element, the intermediate element being elongated and extending between the pair of legs, the pair of legs being structured to be mounted to another structure and to support the intermediate element at a location spaced away from the another structure, the connection apparatus being structured to be installable on the intermediate element.

13. The combination of claim 12 wherein the support further comprises a second engagement element structured to be engageable with the neutral bus and a second connection element that extends between the compression element and the second engagement element, the neutral bus being structured to be disposed between the at least first and second connection elements when the connection apparatus is installed on the neutral bus.

14. The combination of claim 13 wherein the at least first and second connection elements are spaced apart a first distance, at least a portion of the intermediate element being of a width and a thickness orthogonal to one another and to the direction of elongation of the intermediate element, the first distance being greater than the width and the thickness.

15. The combination of claim 14 wherein the lateral opening is interposed between the at least first and second engagement elements, the at least first and second engagement elements being spaced apart a second distance across the lateral opening, the second distance being greater than the thickness but less than the width.

16. The combination of claim 15 wherein the intermediate element comprises an additional portion adjacent the at least portion of the intermediate element and being of the same thickness but being of second width greater than the width, the additional portion of the intermediate element being structured to be engagable by the connection apparatus when the connection apparatus is in a position installed on the neutral bus.

17. The combination of claim 16 wherein the first distance is greater than the second width.

18. The combination of claim 17 wherein the second distance, the width and the thickness are sized to permit the connection apparatus to be movable between a position engaged with the additional portion of the neutral bus and the position removed from the neutral bus by translating the connection apparatus along the direction of elongation of the intermediate element to a position wherein the at least portion of the neutral bus is disposed between the at least first and second connection elements, and by rotating the connection apparatus through an angle of less than about forty-five degrees about an axis parallel with the direction of elongation of the intermediate element to permit the at least portion of the neutral bus to pass through the lateral opening.

19. The combination of claim 16 wherein the intermediate element comprises a step between the at least portion of the intermediate element and the additional portion of the intermediate element.

20. The combination of claim 19 wherein the step is oriented substantially orthogonal to the direction of elongation of the intermediate element.

* * * * *